US006652616B1

(12) United States Patent
Berns et al.

(10) Patent No.: US 6,652,616 B1
(45) Date of Patent: Nov. 25, 2003

(54) POWDER METALLURGICAL METHOD FOR IN-SITU PRODUCTION OF A WEAR-RESISTANT COMPOSITE MATERIAL

(75) Inventors: Hans Berns, Bochum (DE); Birgit Wewers, Herdecke (DE)

(73) Assignee: Maschienfabrik Koppern GmbH & Co. KG, Hattingen (DE)

( * ) Notice: Subject to any disclaimer, the term of this patent is extended or adjusted under 35 U.S.C. 154(b) by 0 days.

(21) Appl. No.: 10/070,729

(22) PCT Filed: Sep. 15, 2000

(86) PCT No.: PCT/EP00/09055

§ 371 (c)(1),
(2), (4) Date: May 28, 2002

(87) PCT Pub. No.: WO01/20049

PCT Pub. Date: Mar. 22, 2001

(30) Foreign Application Priority Data

Sep. 16, 1999 (DE) ..... 199 44 592

(51) Int. Cl.[7] ..... C22C 1/04; C22C 1/05

(52) U.S. Cl. ..... 75/236; 75/244; 419/48; 419/11; 419/13; 419/14; 419/56

(58) Field of Search ..... 419/38, 13, 14, 419/48, 56, 11; 75/236, 244

(56) References Cited

U.S. PATENT DOCUMENTS 3,782,930 A 1/1974 Shibata

FOREIGN PATENT DOCUMENTS

| | | |
|---|---|---|
| DE | 2238473 | 3/1973 |
| GB | 781083 | 8/1957 |
| GB | 2257985 | 1/1993 |
| JP | 61-88701 | 5/1986 |
| JP | 2-270944 | 11/1990 |

OTHER PUBLICATIONS

Q. Fan, H. Chai, Z. Jin: Microstructural evolution in the combustion sysnthesis of titanium carbide. J.Mat. Science 31 (1996), pp. 2573–2577.

Q. Fan, H. Chai, Z. Jin: Microstructural evolution in the combustion synthesis of titanium carbide. J. Mat. Science 31 (1996), pp. 2573–2577.

H. Lehuy, G. Gliche, S. Dallaire: Synthesis and characterization of TI(C,N)–Fe cermets produced by direct reaction. Mat. Sci. and Engin. 125 (1990), L11–L14.

O.N. Dogan, D.E. Alman, J.A. Hawk: Wear Resistant, Powder Processed, in–situ Iron–Matrix TiC Composites. Proc. of the 1996 World Congr. on Powder Metallurgy and Particulate Mat. Jun. 16–21, 1996, Washington, pp. 16–83–16–96.

H. Berns (Hgb) Hartlegierungen und Hartverbundwerkstoffe Springer–Verlag, Berlin 1998, p 275–281.

Berns et al "Effect of coarse hard particles on high–temperature sliding abrasion of new metal matrix composites" excerpt from WEAR, pp. 608–614, 1997.

Berns et al "Wear Resistant Surfaces with a Hardphase Gradient" excerpt from Surface Engineering, pp. 82–90, 1990.

Berns et al "Stainless martensitic PN—HNS" excerpt from High Nitrogen Steels, 1993.

*Primary Examiner*—Daniel J. Jenkins
(74) *Attorney, Agent, or Firm*—Marshall, Gerstein & Borun LLP

(57) ABSTRACT

In accordance with the method according to the present invention, particles consisting of ferrotitanium, ferroniobium or ferrovanadium are dispersed and hot compacted in a metal matrix powder consisting of hardening steel or heat-resistant alloys. In so doing, titanium, niobium or vanadium carbide is obtained in situ by a solid-state reaction, i.e. without melting, from the carbon admixed or contained in the matrix powder and the ferroalloy particles. Carbon can also be absorbed from the gaseous phase and it may be substituted by nitrogen. This method permits a reasonably-priced introduction of hard particles into the composite material, the hard particles having a size that is necessary as a protection against scoring wear.

14 Claims, 1 Drawing Sheet

POWDER METALLURGICAL METHOD FOR IN-SITU PRODUCTION OF A WEAR-RESISTANT COMPOSITE MATERIAL

FIELD OF THE INVENTION

This invention relates to powder metallurgy, and more particularly to ferroalloys dispersed and hot compacted into a metal matrix powder.

BACKGROUND OF THE INVENTION

A known method of increasing the resistance of metallic materials to scoring wear is the insertion of hard particles (HP) which offer resistance to scoring caused by abrasive particles (AP). The efficiency of HP will be optimal when they are (a) harder than the attacking AP,(b) larger than the score cross-section, (c) dispersed in the metal matrix (MM), and (d) fixedly bonded to the metal matrix.

With regard to (a): materials appearing as AP are e.g. natural minerals; most of these natural minerals have a hardness of <1000 V.P.N. (Vickers penetration hardness number), whereas quartz having a hardness of ~1200 V.P.N. and corundum having a hardness of ~2000 V.P.N. are much harder. The hardness of synthetic abrasives is sometimes even higher than that. The HP should have a hardness of from 2000 to 3000 V.P.N. to prevent them being scored especially by harder AP.

With regard to (b): the score widths occurring after erosion are frequently widths of a few $\mu$m, whereas the score widths after grain slip wear and scoring wear are often widths of a few 10 $\mu$m. Hence, HP are required, which have a mean size between 30 and 130 $\mu$m; these values are to be understood as mean diameter or as mesh number.

With regard to c: a dispersion of the HP means that they are arranged in the MM at a mean distance from one another and are therefore not in contact with one another. This results in the shortest mean score length in the matrix and in the highest fracture toughness of the composite material. The adjustment of a dispersion is not trivial and depends on the volume and diameter ratios of the HP and MM powders.

With regard to (d): the bond between HP and MM is established by interdiffusion during hot compacting. Normally, it will be firmer for HP consisting of metal/metalloid compounds than e.g. for metal oxides. The materials used as metalloids are B, C and N, whereas the materials used as metals are some of the subgroups of the 4th to 6th periods, titanium being of particular interest in view of its availability and in view of the high stability and hardness of its metalloid compounds.

The demands (a) to (d) can, in total, only be fulfilled with a metal matrix particle composite material. In the prior art, it is known to mix carbide, boride or nitride powder with a metal matrix powder, the mixing being followed by a hot-compacting step. The formation of titanium boride, carbide and carbonitride from titanium powder and boron or carbon black, if desired, under nitrogen, takes place exothermically until melting occurs. This reaction has already been utilized for producing in situ a composite material from titanium particles mixed with metalloid and MM powder by means of high-temperature synthesis. Instead of titanium powder, also ferrotitanium powder has been used; in this case, the local melting (fusion) led to fine, $\mu$m-sized precipitations due to the in-situ formation of TiC.

BRIEF DESCRIPTION OF THE DRAWINGS

FIG. 1*c* is a schematic representation and designation of phase proportions for the resulting composite material of FIG. 1*a.

DETAILED DESCRIPTION OF THE INVENTION

Figure 1A:
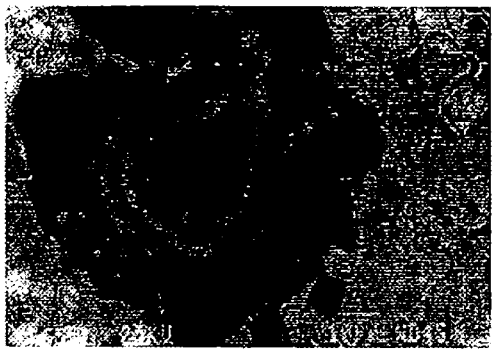
FIG. 1*a* reflects TiC particles formed according to the present invention, with matrix powder×330 CrNi 4–2.
Figure 1B:
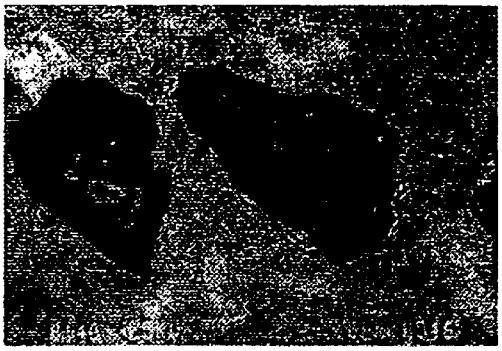
FIG. 1*b* reflects particles formed according to the present invention, with matrix powder 56NiCrMo7 with graphite added.

Ferralloys are used for alloying steels. For reducing the refining cost, a certain percentage of iron remains in the ferroalloys; this has the effect that these ferroalloys are not only moderate in price but also brittle when they have solidified, i.e. they can be reduced to a desired powder grain size. In the case of the method according to the present invention, particles consisting of commercially available ferrotitanium, erroniobium or ferrovanadium are mixed with MM powder and carbon powder in such a way that they are present in dispersed form in the powder charge. During the subsequent hot compacting of the powder mixture, the temperature is kept so low that, due to the diffusion of carbon into the ferroalloy particles, non-melted carbide particles (TiC, NbC, VC) are formed whose core is enriched with the iron component of the ferroalloy. The outer shape and size as well as the distribution of the carbide particles in the MM corresponds to that of the ferroalloy particles. Incipient local melting (incipient local fusion) may occur in the core of the carbide particles formed in situ.

Further embodiments of the method according to the present invention comprise the steps of ($\alpha$) not admixing the carbon required for carbide formation, but additing it as an alloying constituent to the matrix powder, ($\beta$) adding the carbon required for carbide formation by carburizing the powder mixture in a gaseous phase, ($\gamma$) carrying out nitriding instead of carburizing in a gaseous phase so as to convert the ferroalloy particles into nitrides (TiN, NbN, VN).

The method according to the present invention differs from known methods with regard to the following advantages: (1) in-situ formed HP achieve a high hardness of from 2000 to 3000 V.P.N. (2). They are formed in situ from reasonably-priced ferroalloy particles and in a size which, if at all, is available as carbides or nitrides only in the form of an agglomerated powder. However, agglomerated HP do not have a sufficient inherent strength for offering resistance to scoring abrasive particles (3). The HP are dispersed in the metallic matrix.

In comparison with the above, the carbide particles precipitated after the high-temperature synthesis are very fine grained; these carbide particles offer less resistance to scoring. The coarse HP according to the present invention offer the best resistance to scoring wear, when they are supported by a high-strength metal matrix. It follows that MM powders which are particularly suitable for use in the present connection are those consisting of hardening steels and for elevated application temperatures those of high-temperature steels as well as nickel and cobalt alloys.

The high wear resistance of the in-situ formed composite material according to the present invention will be explained in comparison with known composite materials on the basis of an embodiment. For producing the materials presented, the hardening steel 56 NiCrMoV7 with a mean powder grain size of 55 $\mu$m was used as a matrix powder. In the case described in accordance with the present invention, 10% by volume of ferrotitanium particles with approx. 70% by weight of titanium were admixed as well as carbon powder in a molar ratio of Ti/C=1/1. For the production of the known composite materials 10% by volume of boride particles were admixed. The hot-isostatic pressing of the evacuated powder capsules to full density took place at 1100° C. for 3 hours under a pressure of 140 MPa from all sides. By means of subsequent hardening and tempering, a matrix hardenss of approx. 700 V.P.N. was adjusted.

The specimen produced in this way were moved against corundum emery paper, grain size 80, over 50 m under a surface pressure of 1.32 MPa, and the dimensionless wear resistance $w^{-1}$ was determined. The following results were obtained as average values of three measurements:

| | hard particles in the composite material | | | |
|---|---|---|---|---|
| | type | size $\mu$m | Hardness V.P.N. 0.05 | wear resistance $w^{-1}$ $10^4$ |
| A | TiC[2)] | 70[b)] | 2,500 to 3,000 | 5,54 |
| B | $CrB_2$ | 70[b)] | 2,650[b)] | 4,65 |
| C | $TiB_2$ | 12[b)] | 3,060[b)] | 2,06 |
| D | without any hard particles | | | 2,32 |

[2)]formed in situ according to the present invention,
[b)]average value

The comparison shows that 10% by volume of hard particles arlready cause a clear change in the wear resistance in comparison with the pure metal matrix which does not contain any hard particles (D) and that the composite material (A) formed according to the present invention in situ with ferrotitanium particles and carbon has the highest wear resistance. Chromium diboride is available in a comparably coarse grain size, but it tends to dissolve in the matrix and achieves a lower wear resistance (B). Although titanium diboride is still harder than titanium carbide, it does not provide an increased wear resistance (C) in view of the particle size which is too small. Since, due to the disadvantageous grain-size ratio between the MM and the HP powder, $TiB_2$ is not dispersed in the matrix but distributed therein in the form of a net, the wear resistance will even decrease in comparison with D in view of the resultant embrittlement of the material. The disadvantageous behavior of C has to be expected also in cases in which commercially available fine TiC powder is admixed. The in-situ formation of coarse TiC particles from coarse ferrotitanium particles and carbon in a composite material is a new possibility of utilizing the excellent properties of the hard material TiC in composite materials also in the case of scoring stress producing deeper scores.

Figure 1C:
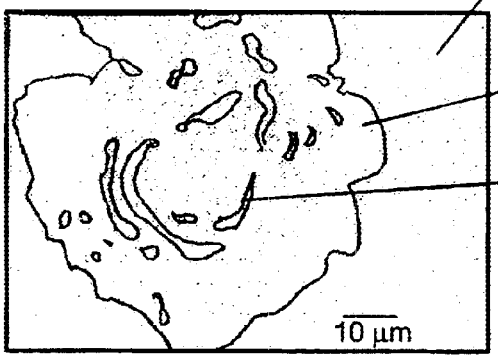
Figure 1D:
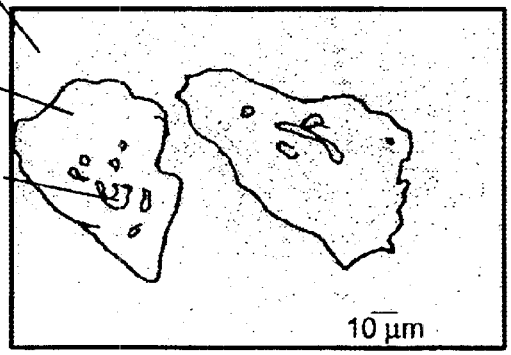
* and FIG. 1*d* is a schematic representation and designation of phase proportions for the resulting composite material of FIG. 1*b*.

In a further embodiment it is shown that, instead of an admixture of carbon, said carbon can also be taken from a high-carbon matrix powder for TiC formation. For this purpose, case iron×330 NiCr 4–2 alloyed as a matrix powder was mixed with ferrotitanium powder, without any addition of carbon, and compacted by hot-isostatic pressing, such as at 1,100° C. In FIG. 1(*a–d*) an in-situ formation of TiC particles can be discerned that corresponds to that taking place in the case of A. In FIG. 1*a,* the iron matrix powder is ×330 NiCr 4–2, while in FIG. 1*b,* the iron matrix powder is 56 NiCrMoV7, having graphite added thereto. In FIGS. 1*c* and 1*d,* there are schematic representations and designations of the phase propositions of the TiC particles formed with the iron matrices of FIGS. 1*a* and 1*b,* respectively. The fields designated in FIGS. 1*c* and 1*d* by Fe, Ti (which apper bright in FIGS. 1*a* and 1*b*) contain more iron and less carbon than TiC, and part of them are present in an eutectically solidified form. At lower temperatures, no liquid phase occurs.

What is claimed is:

1. A method for the powder-metallurgical production of wear-resistant composite materials comprising the steps of dispersing, by mixing, powder particles consisting of ferrotitanium and/or ferroniobium and/or ferrovanadium in a metal matrix powder with a percentage of less than 50% of the total powder volume supplying carbon and/or nitrogen wherein the powder mixture is compacted by hot compacting so as to form a metal matrix particle composite material and that the dispersed powder particles of the ferrotitanium and/or ferroniobium and/or ferrovanadium are converted in situ into carbide and/or nitride particles essentially without melting of said powder particles.

2. A method according to claim 1, wherein powder consisting of hardening steel is used as a metal matrix powder, at least as a main component thereof.

3. A method according to claim 1, wherein the mole content of the added, i.e. supplied carbon and/or nitrogen corresponds to the mole content of the titanium and/or of the niobium and/or of the vanadium in the ferrotitanium or ferroniobium or ferrovanadium.

4. A method according to claim 1, wherein the carbon and/or the nitrogen is/are admixed to the powder mixture in particle shape.

5. A method according to claim 1, wherein the titanium content in the ferrotitanium or the niobium content in the ferroniobium or the vanadium content in the ferrovanadium is 70±5% by weight.

6. A method according to claim 1, wherein the mean screen size of the ferrotitanium or the ferroniobium or the ferrovanadium is between 30 and 130 $\mu$m.

7. A method according to claim 1, wherein the hot compacting is carried out by hot-isostatic pressing.

8. A method according to claim 1, wherein the carbon or nitrogen required for in-situ formation of carbide particles and/or nitride particles is contained in the metal matrix powder on a basis of iron in such amounts that the formation of the carbide and/or nitride is fed thereby without any substantial decrease of the hardenability in the matrix.

9. A method according to claim 1, wherein carbon is supplied to the powder mixture prior to or during the hot compacting by carburizing in a gaseous phase.

10. A method according to claim 1, wherein nitrogen is supplied to the powder mixture prior to or during the hot compacting by nitriding in a gaseous phase.

11. A method according to claim 1, wherein powder consisting of a heat-resistant iron, nickel and/or cobalt alloy is used as a metal matrix powder, at least as a main component thereof.

12. A method according to claim 1, wherein, during hot compacting, the composite material is joined in the form of a layer to a metallic substrate so as to form a laminated composite.

13. A wear-resistant composite material produced by a method according to claim 1, including carbide and/or nitride particles which have an average size of from 30 to 130 $\mu$m and which are dispersed in a metal matrix consisting of hardening steel, heat-resistant steel or a nickel or cobalt alloy.

14. A method according to claim 1, wherein carbon and/or nitrogen is supplied to the powder mixture in a form selected from the group consisting of a carbon powder; a carbon gas; a carbon constituent of the metal matrix powder; a nitriding gas; and a mixture thereof.

* * * * *

UNITED STATES PATENT AND TRADEMARK OFFICE

CERTIFICATE OF CORRECTION

PATENT NO. : 6,652,616 B2
DATED : November 25, 2003
INVENTOR(S) : Hans Berns and Birgit Wewers It is certified that error appears in the above-identified patent and that said Letters Patent is hereby corrected as shown below:

Title page, Item [54] and Column 1, line 1,
Title, replace "POWDER METALLURGICAL" with -- POWDER-METALLURGICAL --

Title page,
Item [73], Assignee, replace "Koppern" with -- Köppern --

Column 4,
Line 9, replace "volume" with -- volume, --

Signed and Sealed this

Thirtieth Day of March, 2004

JON W. DUDAS
*Acting Director of the United States Patent and Trademark Office*